US005382326A

United States Patent [19]

Szopinski et al.

[11] Patent Number: 5,382,326

[45] Date of Patent: Jan. 17, 1995

[54] OZONE MIXING TEST APPARATUS

[75] Inventors: Ryszard Szopinski; Vincent Fragassi, both of Glens Falls, N.Y.

[73] Assignee: Kamyr, Inc., Glens Falls, N.Y.

[21] Appl. No.: 870,374

[22] Filed: Apr. 17, 1992

[51] Int. Cl.[6] ..... D21C 9/153; D21C 7/12

[52] U.S. Cl. ..... 162/238; 162/65; 162/263; 162/243; 422/62; 422/110; 422/111; 366/132

[58] Field of Search ..... 162/49, 57, 198, 263, 162/238, 61, 62, 246, 243; 422/62, 110, 111; 366/132, 101, 106

[56] References Cited

U.S. PATENT DOCUMENTS 4,662,991 5/1987 Karna et al. ..... 162/49
4,854,713 8/1989 Soechtig ..... 422/111

OTHER PUBLICATIONS

Laxen et al, *Paper and Timber* at 72 (1990):5, "Medium Consistency Ozone Bleaching".

Greenwood, Szopinski, "Ozone Bleaching Technology '92" Paper presented at Non-Chlorine Bleaching Conference, Mar. 2-5, 1992.

*Primary Examiner*—Steve Alvo

*Attorney, Agent, or Firm*—Nixon & Vanderhye

[57] ABSTRACT

Laboratory equipment for practicing experiments and mixing ozone with medium consistency cellulosic pulp allows precise control of the timing and amount of ozone injected into the mixer, providing a method of testing that is more accurate than prior methods. An injection cylinder and fluidizing laboratory mixer are utilized. Pulp is fed into the mixer, the cylinder is charged with a known predetermined amount of ozone containing gas, the ozone containing gas is injected from the cylinder into the mixer, the mixer is operated to effect mixing of the ozone containing gas with the pulp for a predetermined period of time, and then gas containing residual ozone (which has not reacted with the pulp) from the mixer is vented from the mixer, including by utilizing a purge gas such as nitrogen. The ozone is created by an ozone generator which continuously operates. A three-way valve directs the output of the ozone generator to an ozone destruction device when the ozone is not being charged into the cylinder. A residual ozone analyzer is disposed in the vent of the mixer between it and the ozone destruct system, and may comprise a pair of potassium iodide solution containing vessels. Automatic valves and controls are provided for completely automating the testing sequence.

15 Claims, 5 Drawing Sheets

OZONE MIXING TEST APPARATUS

BACKGROUND AND SUMMARY OF THE INVENTION

In recent years, there has been an enormous amount of laboratory activity testing ozone for bleaching cellulose pulp. Ozone is considered one of the potentially most advantageous future bleaching chemicals since it does not have the environmental drawbacks of chlorine, and reacts quickly with cellulose pulp. A number of experiments have been carried out utilizing cellulose pulp at medium consistency (i.e., about 6 to 18%) since that is a desirable consistency at which to effect bleaching if possible, and heretofore not much has been known about medium consistency ozone bleaching since conventional wisdom in the art was that it was not feasible.

According to the present invention, a method and apparatus are provided for conducting laboratory experiments treating cellulosic pulp with gas containing ozone as the primary reactive ingredient. Conventional prior laboratory apparatus, such as shown in FIG. 1 of an article by Laxen et al published in *Paper and Timber* at 72 (1990):5 and entitled "Medium-Consistency Ozone Bleaching" utilize an ozone pressure vessel. This vessel is a twenty-liter vessel used to store or discharge the ozone-oxygen gas mixture into the reactor/mixer. However, due to the large volume of this vessel and the inherent variation of the temperature and pressure of the gas mixture during discharge, and because a complex mathematical formula of questionable accuracy must be utilized to calculate the amount of ozone, the amount of ozone actually discharged to the reactor/mixer was difficult, if not impossible, to accurately determine utilizing this laboratory apparatus.

The method and apparatus according to the present invention overcome the drawbacks of the prior art. According to the present invention the inaccuracies present in determining the amount of ozone discharged into the reactor/mixer that were inherent in the prior art no longer exist. Also, since the ozone generator is connected to other components in such a way that it can be run continuously, problems associated with inconsistent ozone quality are also eliminated. The system according to the present invention is totally automated and computer controlled, allowing accurate yet simple practice of laboratory experiments for the ozone bleaching of pulp.

According to one aspect of the present invention, a method of conducting laboratory experiments treating cellulose pulp with gas containing ozone, using an injection cylinder and a laboratory mixer is provided. The method comprises the following steps: (a) Feeding cellulosic pulp into the mixer. (b) Charging the cylinder with a known predetermined amount of ozone containing gas. (c) Injecting the ozone containing gas from the cylinder into the mixer. (d) Mixing the ozone containing gas with the pulp in the mixer for a predetermined period of time. And (e) venting gas containing residual ozone which has not reacted with the pulp from the mixer, including by using purge gas. There is also preferably the further steps (f) of verifying the amount of ozone in the cylinder after charging but before injecting, (g) continuously creating ozone from oxygen containing gas and (h) when step (b) is not being practiced, effecting destruction of the ozone being continuously produced; and (i) determining the amount of residual ozone in the gas vented in step (e). Multiple or partial injections may also be used for the ozone charge to the mixer for a particular test.

According to another aspect of the present invention a laboratory apparatus is provided for practicing experiments mixing ozone with cellulosic pulp. The apparatus comprises the following components: An ozone generator. A cylinder housing with a movable piston, and means for moving the piston to eject gas from the housing. A mixer for mixing ozone containing gas with pulp, and having a vent. First conduit means connecting the ozone generator to the cylinder. Second conduit means connecting the cylinder housing to the mixer. First automatically operated valve means disposed in the first conduit means for selectively directing ozone from the generator to the cylinder housing. And second automatically operated valve means disposed in the second conduit means for selectively allowing or preventing ozone containing gas from passing from the cylinder housing to the mixer.

The mixer is preferably a fluidizing mixer, and the vent from the mixer is connected to an ozone destruct device through a residual ozone analyzer (such as a pair of vessels filled part way with potassium iodide solution and having the inlet to each vessel extending below the level of the potassium iodide, and the outlet extending from above the level of potassium iodide, the vessels connected in series). Control means are also provided for controlling the means for moving the piston, and the first and second automatically operated valves, for injecting a predetermined amount of ozone containing gas into the mixer at a desired time between just prior to mixer start up and to about one second after mixer start up.

According to yet another aspect of the present invention, a laboratory injection cylinder assembly is provided. This assembly comprises: A cylinder housing. A piston disposed in the housing and having a first face and a second face opposite the first face. A piston rod extending generally perpendicularly to the piston second face, exteriorly of the housing. A transducer connected to the piston rod for determining the position of the piston rod with respect to the interior of the cylinder housing. A first port disposed in the cylinder housing on a portion thereof adjacent the piston first face when the piston is disposed at a first end of the housing. A first conduit connected to the first port, and branching into second and third conduits. And first and second automatically operated valves, the first valve disposed in the second conduit, and the second valve disposed in the third conduit.

The piston preferably is of PVC or like plastic, connected by threads to the piston rod and elongated a substantial distance (e.g., almost three inches) in the dimension of the piston rod. It preferably includes first and second circumferential O-rings disposed circumferentially around the piston between the first and second faces thereof.

It is a primary object of the present invention to provide for the accurate, yet simple to perform, practice of laboratory experiments treating cellulose pulp with ozone containing gas, particularly when the pulp has a consistency of about 6–18%. This and other objects of the invention will become clear from an inspection of the detailed description of the invention and from the appended claims.

DETAILED DESCRIPTION OF THE DRAWINGS

Figure 1:
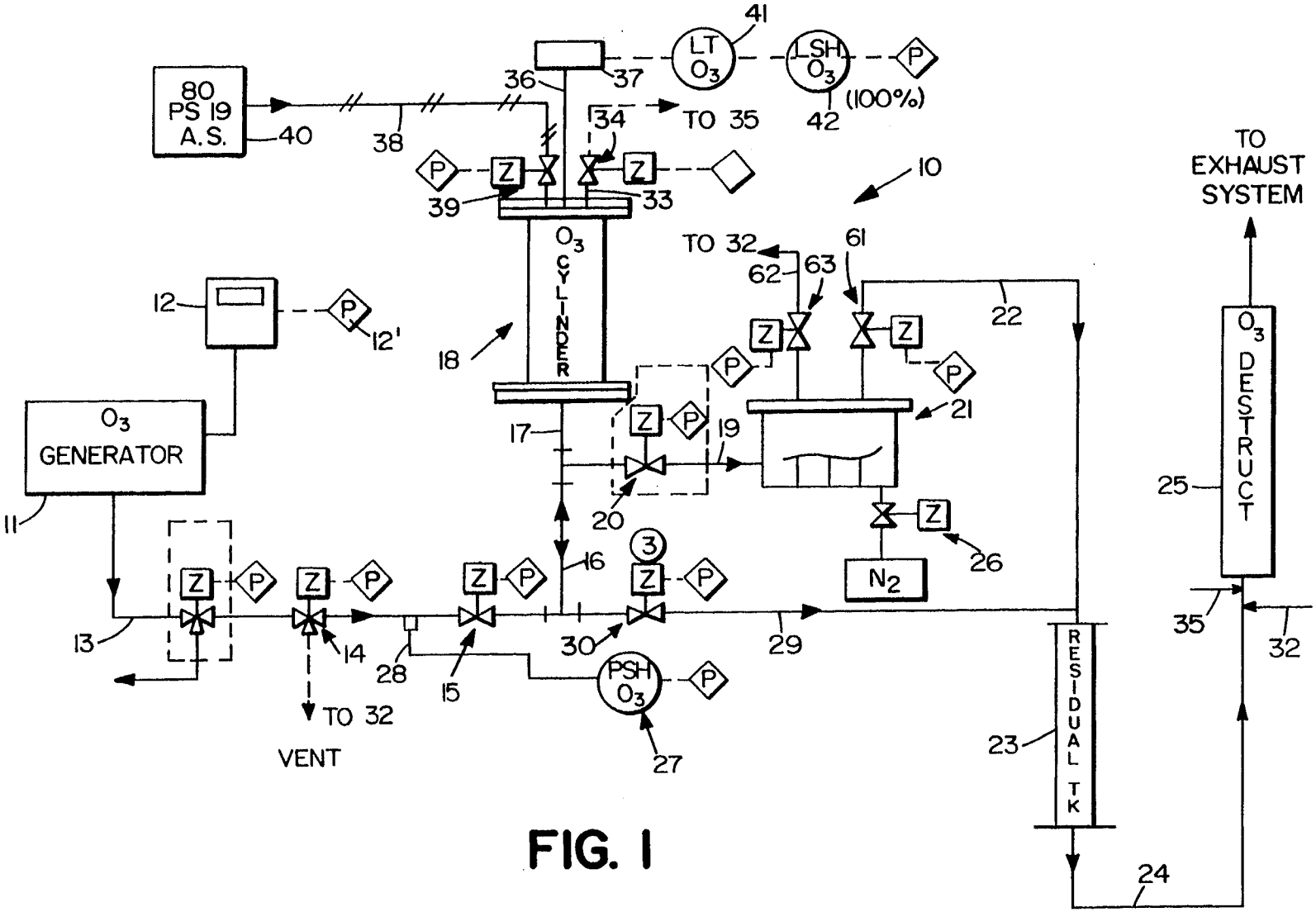
FIG. 1 is a schematic view illustrating most of the components of the laboratory apparatus according to the invention, for practicing the method according to the invention.

Exemplary apparatus according to the present invention is shown generally by reference numeral 10 in FIG. 1. The apparatus 10 includes a conventional ozone generator 11, such as one commercially available from PCI, Inc. It is connected to a conventional ozone concentration meter 12 (having a PLC Input/Output 12'), and the gas in the conduit 13 extending therefrom contains—when the generator 11 is uniformly and continuously operated—a known percentage of ozone (typically about 3 to 10%) which has been produced from oxygen gas fed to the generator 11. Disposed in the conduit 13 is a first solenoid operated, three-way, valve 14, as well as a second, "charge" solenoid operated valve 15. A second conduit branch 16 extends from the branch 13, with an extension 17 therefrom leading to an injection cylinder assembly 18 for injecting a predetermined amount of ozone containing gas through the conduit 19 and injection valve 20 into a mixer 21. The assembly 18 is of unique design according to the invention, and is shown more clearly in FIG. 2. The mixer 21 is a conventional high-shear, fluidizing mixer such as available from Quantum Technologies, Inc., with simple modifications to improve its performance under the unique loads it experiences in the laboratory apparatus.

Figure 3:
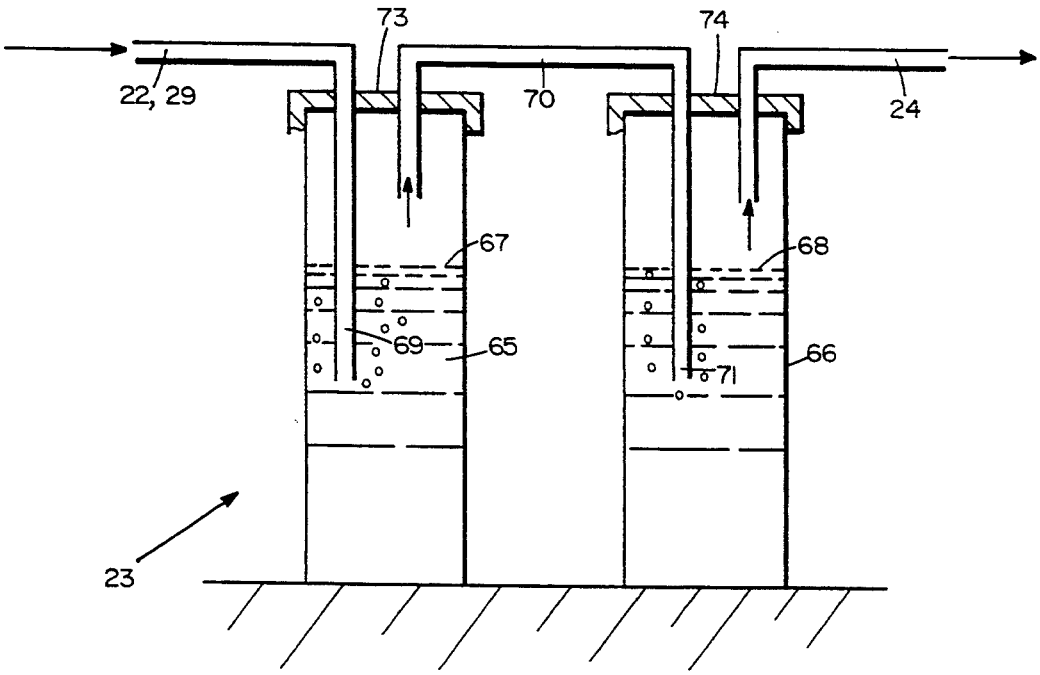
FIG. 3 is a side schematic view of an exemplary residual ozone analyzer according to the present invention.

The mixer 21—which is capable of fluidizing medium consistency cellulose pulp (e.g., having a consistency of about 6–18%)—has a vent line 22 extending therefrom to a residual ozone analyzer 23, shown in more detail in FIG. 3. A line 24 leads from the analyzer 23 to a conventional ozone destruction device 25, which may, for example, be a commercially available catalytic type destructor such as manufactured by PCI, Inc. Gas exhausted from the destruction unit 25 typically has no significant amounts of ozone therein.

A purging system 26, including a source of purge gas (such as nitrogen, noble gas, air or the like) is connected by a solenoid controlled valve to the mixer 21 to effect purging of gas therefrom.

Associated with the line 13 is a pressure switch 27, connected thereto at 28, for sensing the pressure generated within the injection cylinder assembly 18. Downstream of line 13 is a line 29, connected to the line 22 and the residual ozone analyzer 23. A solenoid operated valve 30 is also disposed in the line 29. One of the unique features of the method and apparatus according to the invention is that the ozone generator 11 may be run continuously. Since the valve 14 is a three-way valve, when the injection cylinder assembly 18 is filled with ozone containing gas, and the valves 15/30 are closed, the valve 14 is operated to a position which vents the continuously produced ozone to the inlet 32 just prior to ozone destruct device 25.

Connected to the top of the assembly 18 is a vent line 33 having a solenoid control valve 34, which line 33 may be vented, for maximum safety (in case there is leakage within the assembly 18) to the inlet 35 just prior to the ozone destruct device 25. Alternatively, the vent of the conduit 33 may be vented to atmosphere. Extending outwardly from the assembly 18 is a portion 36 of a piston rod of assembly 18, portion 36 being connected to a conventional displacement transducer 37 such as manufactured by Celesco, Inc., comprising a retractable cord, the extension of which generates a 4–20 mA signal which is proportional to the displacement.

Also connected to the same end of the cylinder assembly 18 as the conduit 33 is a conduit 38, with the solenoid operated valve 39 disposed therein. Conduit 38 is connected up to a source 40 of operating fluid under pressure, such as 80 psig air. The transducer 37 is connected up to conventional displays/controls 41, 42 to allow one to determine the displacement of the piston rod portion 36.

Figure 2:
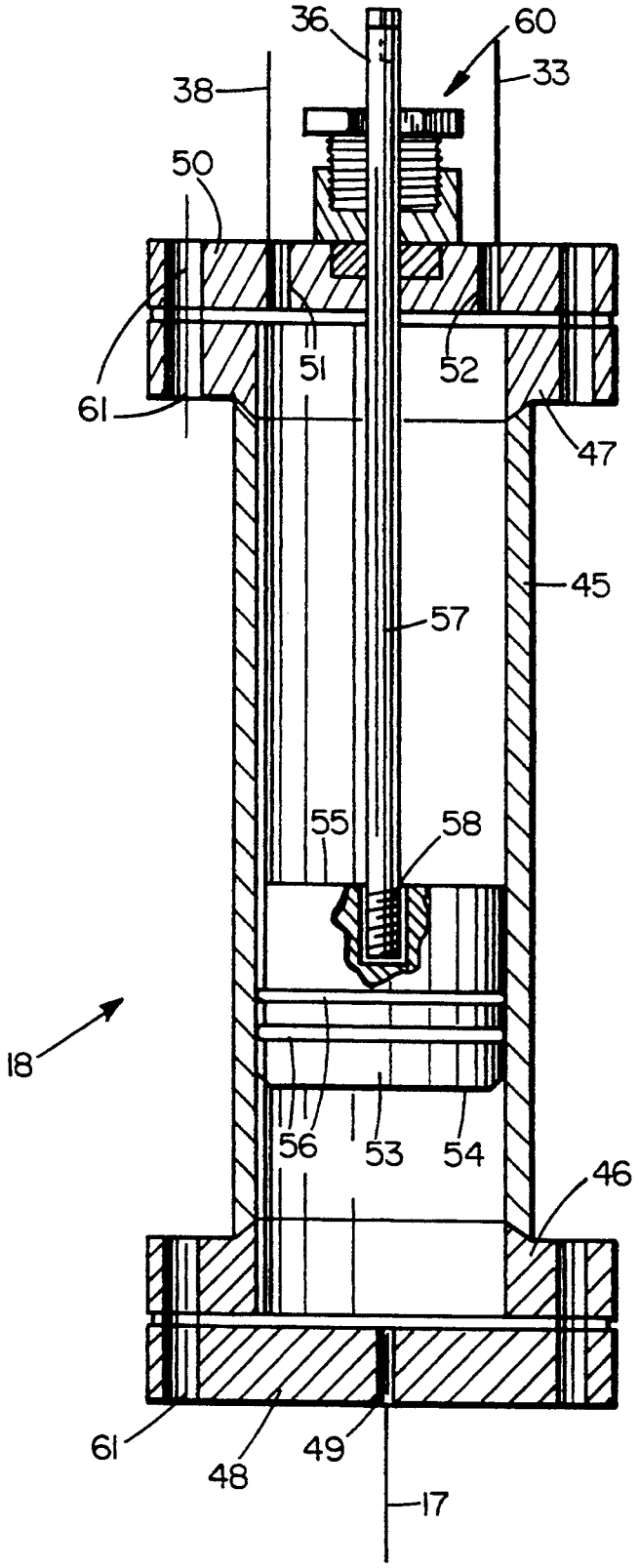
FIG. 2 is a side cross sectional view, partly in elevation, showing an exemplary injection cylinder assembly according to the present invention.

The laboratory injection cylinder assembly 18 according to the present invention is seen most clearly in FIG. 2, in which the cylinder housing 45 is shown in sectional view, while the piston 53 and piston rod 57 are shown in elevational.

The housing 45 is circular in cross section and hollow in the interior, and has flanges 46, 47 at first and second opposite ends thereof, covered by end plate 48 with port .49 therein, and end plate 50 with ports 51, 52 therein. The port 49 connects to the conduit 17, while the ports 51, 52 connect to the lines 38, 33, respectively. The volume of the interior of cylinder housing 45 below the piston 53 (when in a raised position) is normally equal to a desired charge for mixer 21 at desired pressure. However, multiple or partial injections also can be utilized. For example, the desired ozone charge for a particular test may include 3½ injections (volume of housing 45 below piston 53) of ozone from assembly 18 to mixer 21.

The piston 53 preferably is of plastic material, e.g., PVC, and has a first face 54 and a second face 55 and a pair of circumferentially extending Viton O-rings disposed therearound. The piston has a substantial length along the interior of the housing 45 (e.g., almost 3 inches), and may have a width (diameter) of about 3½ inches, and the O-rings 56 may be disposed in 0.18 inch deep slots extending circumferentially around the PVC piston body.

The piston rod 57 has a portion interior of the housing 45, as well as a portion 36 exterior of the housing, and is preferably releasably connected to the piston 53 as by the screw threading 58. The screw threading within the piston may be within a tapered stainless steel sleeve. The piston rod portion 36 is connected at the top thereof to the transducer 37. At the top of the housing 45, particularly in the face plate 50 thereof, a bushing 60 is provided for the shaft 36/57 to extend through the housing 45. The through extending openings 61 are provided in the faces 48, 50 and in the flanges 46, 47 to receive bolts which clamp the components together.

The residual ozone analyzer 23 (see FIG. 3) preferably comprises first and second vessels 65, 66. A liquid is disposed in each of the vessels 65, 66, reaching the levels 67, 68 respectively. The liquid preferably is a 2% KI solution. The first vessel 65 has an inlet 69 extending below the level 67, and an outlet 70 from above the level 67, while the second vessel 66 has an inlet 71 below the level 68, and the outlet 24 is from the above level 68. The covers 73, 74 are provided on the vessel 65, 66 in gas tight relationship with the conduit 69, 70, etc.

In utilizing the apparatus 23, the residual ozone containing gas in line 22 bubbles through the KI solutions in the vessel 65, 66. The solutions are then mixed and titrated with 0.1N or 1.0N sodium thiosulfite. The titrated volume is then used to calculate the mass of ozone (in grams) present in the ozone carrying gas charge, as is known per se. The apparatus 23 can be used both for verification of the charge amount in the apparatus 18 the first time it is operated for a given series of experiments, and then to determine the residual ozone from each charge from each operation of the mixer 21.

Figure 4A:
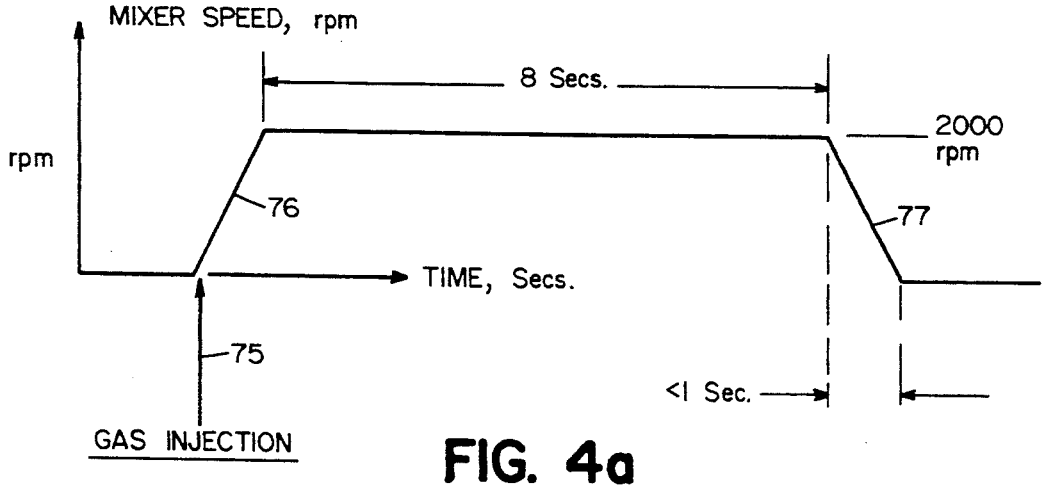
FIGS. 4*a* and 4*b* are graphical representations showing typical mixing and gas injection schedules utilizing the apparatus according to the invention.
Figure 4B:
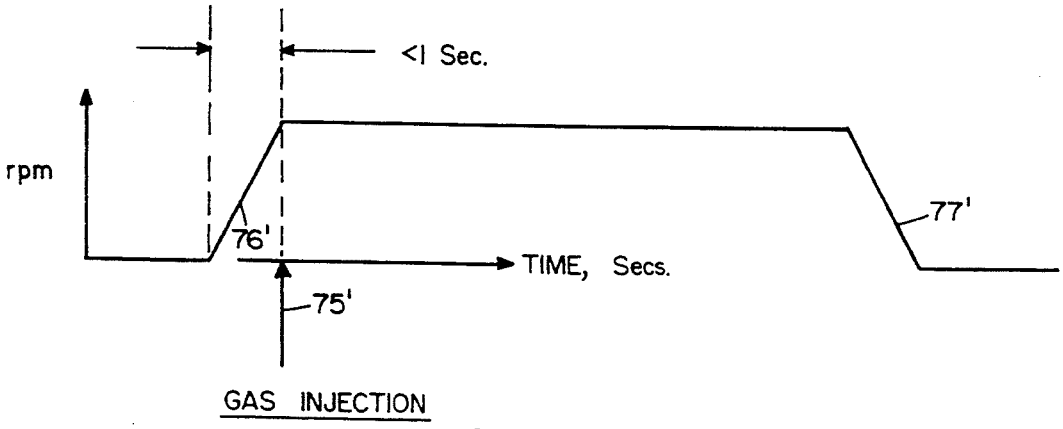

FIGS. 4*a* and 4*b* are graphical representations of typical mixing and gas injection schedules. On the Y axis is the rpm of the mixer 21 is plotted (typically about 1000–3000 rpm, sufficient to fluidize medium consistency pulp), while on the X axis the time for mixing, in seconds, is plotted. 75 indicates the point of gas injection in FIG. 4*a*, and 75′ in FIG. 4*b*. The slope 76 indicates the rpm versus time plot while the mixer 21 is accelerating from 0 to the desired velocity (2000 rpm in the drawings), while the slope 77, 77′ indicates slowing down of the mixer 21 from the desired velocity to zero. The X-plot (time) for each of the slopes 76, 76′ and 77, 77′ is typically slightly less than about 1 second, while the time between slope 76, 77, 76′ 77′ is typically about 6–8 seconds, so that the total time for the mixing operation is about 8–10 seconds. In FIG. 4*a*, an injection at 75 takes place just prior to the mixer start up, while in FIG. 4*b*, the injection 75′ takes place as soon as the mixer reaches the desired rpm.

Figure 5:
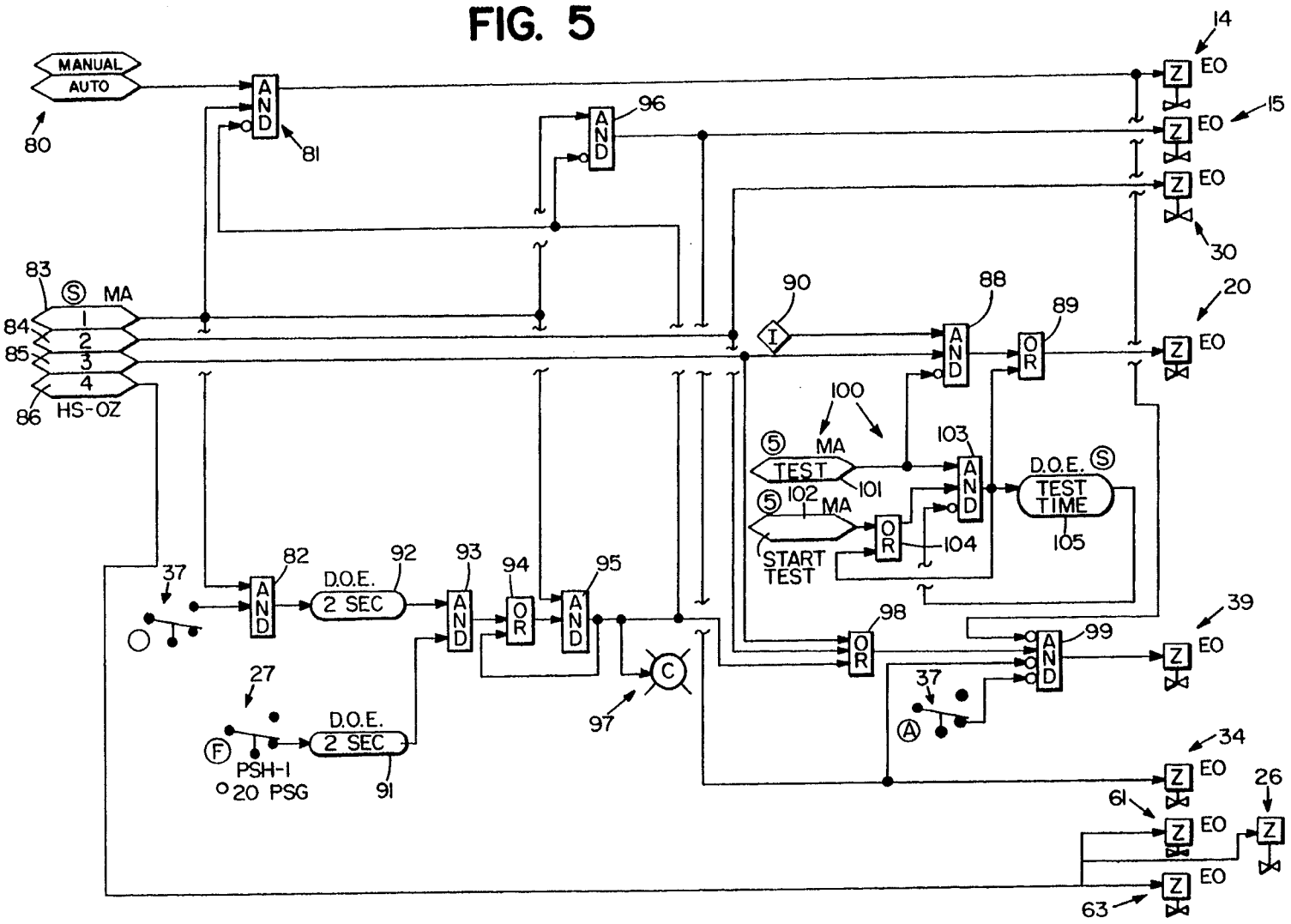
FIG. 5 is a control schematic for the apparatus of FIGS. 1 through 3.

FIG. 5 is a control schematic for the operation of all of the components of the apparatus 10 to achieve the desired control sequence and method of laboratory experiment practice. The software utilized to control the apparatus schematically illustrated in the control schematic 79 may be Iconic's Genesis® software in conjunction with a Modicon® Programmable Logic Controller (PLC) hardware loaded with Modicon® Gray Soft TM software, providing interactive computer control with color graphic display.

The operator inputs are provided by the manual and automatic inputs 80, connected through an AND logic device 81 to the ozone generator isolation solenoid valve 14, and controlled in part by the field pressure switch 27 (through elements 91 and 93–95). The AND logic device 82 is controlled by the displacement transducer 37. Mode 83 is operatively connected to AND logic devices 95 and 96, as well as AND logic devices 81 and 82. Mode 84 is connected to the residual solenoid control valve 30, and to OR device 98. Mode 85 is connected to AND logic device 88, which in turn is connected through OR logic device 89 to injection solenoid 20. The existing injection signal is provided by control 90 to AND device 88. Mode 85 is also connected up to OR device 98. Mode 86 is connected to the solenoid control valve 26, 61, and 63 associated with venting and purging the mixer 21.

The switch 27 is connected through a two second D.O.E. 91 to the AND logic device 93, while the AND logic device 82 is connected through the two second D.O.E. 92 to the AND logic device 93. The logic device 93 is connected to OR logic device 94, which in turn is connected to AND logic device 95. An indicator light 97 (e.g. green) indicates that it is appropriate to select the next switch mode 83–86. The AND device 95 is connected to the OR logic device 98 (connected to the other elements as earlier indicated), which in turn is connected to the AND logic device 99, the devices as illustrated in FIG. 5 operatively controlling the cylinder pressure solenoid 39 and the cylinder vent solenoid 34 as illustrated.

The logic circuitry and controls 100 are utilized to define a separate testing procedure from the automatic testing sequence defined above. The manually operated "test" mode 101 and the "start test" mode 102 are utilized to control the displacement of the injection cylinder piston 53 for a given time, in order to determine the volume displaced from the injection cylinder assembly 18 during the specified time. (To establish a time versus volume-displace relationship.) The time versus volume-displace relationship (curve) is then used to determine the time the piston 53 is allowed to move in order to inject a specific cylinder volume. This can then subsequently be used to inject partial charges from the assembly 18 into the mixer 21, such that, for example, 3½ cylinder volumes can be injected during a particular test. The mode 101 is connected to the AND logic devices 88, 103, while the "start test" mode 102 is connected to the OR logic device 104, which in turn is connected to the AND logic device 103, with an input from the OR logic device 89. The AND logic device 103 is in turn connected to the test time D.O.E., that in turn providing an input to the AND logic device 103.

In a typical test sequence utilizing the elements 100, the injection cylinder assembly 18 is precharged with ozone in the usual manner. The test mode is entered by pressing "test" mode 101. A stroke time (test time) is specified at 105, e.g. 0.25 seconds, 0.5 seconds, etc. The test is then initiated by pressing "start test" mode 102. The piston 53 is displaced for the specified time (e.g. 0.25 seconds), and then stops. The volume displaced is determined from the area of the cylinder face 54 and the displacement transducer 37 signal. The process is repeated for other selected stroke times (by acting on device 105), to define a time versus displaced volume curve.

Table I shows the valve status during each mode, where "C" indicates that the valve is de-energized, and "O" indicates that it is energized.

TABLE I

| Valve Reference # | 26 | 14 | 15 | 30 | 20 | 39 | 34 | 61 | 63 | Mode |
|---|---|---|---|---|---|---|---|---|---|---|
| Cylinder Charge MC | C | O | O | C | C | C | O | C | C | 83 |
| Injection to Washers (Residual) | C | C | C | O | C | O | C | C | C | 84 |
| Injection to Bowl | C | C | C | C | O | O | C | C | C | 85 |
| Purging of Bowl | O | C | C | C | C | C | C | O | O | 86 |
| Cylinder Pressurized | C | C | C | C | C | O | C | C | C | 83 |

The exemplary apparatus according to the invention having been described, the method of conducting laboratory experiments treating cellulosic pulp (e.g., medium consistency pulp) with gas containing ozone as the primary reactive ingredient will now be described.

The cellulosic pulp is first fed into the mixer 21 by means of suction generated by a partial vacuum, and is discharged from the mixer 21 after the entire operation has been completed, also in the conventional manner.

The cylinder assembly 18 is charged with a known predetermined amount of ozone containing gas. This is accomplished by opening the valve 34 to vent, e.g. to line 35. Ozone from the generator 11 is directed by line 13 through the three-way valve 14, and open valve 15 (the valves 20 and 30 are closed) to the port 49, to press against the face 54 of piston 53 causing the piston 53 to be displaced to the top of the housing 45, which is detected by the displacement transducer 37 cooperating with the piston portion 36. When displacement to the top of the cylinder housing 45 is detected by the transducer 37, the vent valve 34 is closed, establishing a fixed volume within the cylinder 45. The cylinder assembly 18 continues to charge with ozone until a predetermined pressure, which may be between 0–50 psi, is generated within the assembly 18, as indicated by the switch 27. At the predetermined pressure, charge valve 15 closes, while the valve 14 is controlled to vent to the inlet 32 to the ozone destruct device 25. After a short delay (e.g., about 10 seconds), air from pressurized supply 40 (e.g., 60–80 psig) is rapidly supplied through the valve 39 to the second piston face 55, through port 51, causing the piston 53 to move rapidly downwardly (see FIG. 2) and compress the ozone carrying gas beneath it such that it is at about 60–70 psi. This pressure is the driving force for the injection into the mixer 21, which takes place through the open valve 20 (valves 15 and 30 being closed at this time).

The ozone concentration signal from the PLC input-/output 12' of ozone meter 12 is used as the input to the PLC to calculate the mass of ozone charged into assembly 18, and then mixer 21. However, sometimes it is desirable to verify the ozone charge for a series of experiments prior to the first mixing charge through valve 20 into mixer 21. For this purpose the line 29 and valve 30 are provided. Verification can also, alone, establish a repeatable state for the ozone carrying gas, by determining the mass of the ozone. In verification, the mass is determined by directing the ozone charge from the cylinder assembly 18 through conduit 17, 16, and 29 (valve 30 being open) to the analyzer 23. The gas is bubbled through the KI solutions in the gas washers 65, 66 (e.g. such as those available from Fisher Scientific), and the solutions in the gas washers 65, 66 are mixed, then titrated, etc., as described above with respect to the determination of residual ozone.

During the injection sequence, the valves 15, 30 are closed and the valve 20 is open. The total cycle time for injection is typically about 8 to 10 seconds, with exemplary schedules being illustrated in FIGS. 4*a* and 4*b*. The mixer typically is accelerated to a speed to effect fluidization of the pulp, typically 1000–3000 rpm (e.g., 2000 rpm). The charging, injection, and mixing sequence may be repeated until the pressure in the mixer 21 approaches the driving pressure available from shop air source 40, or mixer 21 may be purged after each injection, whichever is desirable.

The purge mode allows displacement of the residual gas present in the mixer 21 and determines the amount of residual ozone left in mixer 21 after reaction is complete. The process is similar to the verification process in a number of ways, in that the residual ozone containing gas is fed to the analyzer 23. This is accomplished by opening valve 61 to vent the residual gas in line 22 to the apparatus 23, and opening the purge valve 26 to purge the mixer 21 with non-ozone containing gas such as air, oxygen, nitrogen, the noble gases, or the like. The amount of residual ozone is determined by titration, etc., as described above, and then the valve 61 is closed, allowing the next sequence of operation.

Throughout the entire time, the ozone generator 11 is operating so that the quality of the ozone remains substantially the same. The valve 14 is merely controlled to either feed the ozone generated to destructor 25 or to the cylinder assembly 18. The ozone in line 24 from the apparatus 23 also is obviously destroyed by the destruct system 25.

It will thus be seen that according to the present invention a method and apparatus are provided which allow for the accurate practice of laboratory experiments for treating pulp, especially medium consistency pulp, with ozone containing gas. The invention also relates to a novel injection cylinder assembly. While the invention has herein been shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. Laboratory apparatus for practicing experiments mixing ozone with cellulosic pulp, comprising:

an ozone generator;

a cylinder housing with a movable piston, and means for moving said piston to eject ozone containing gas from said housing;

a mixer for mixing said ozone containing gas with pulp, and having a vent;

first conduit means connecting said ozone generator to said cylinder;

second conduit means connecting said cylinder housing to said mixer;

first automatically operated valve means disposed in said first conduit means for selectively directing ozone from said generator to said cylinder housing;

second automatically operated valve means disposed in said second conduit means for selectively allowing or preventing ozone containing gas from passing from said cylinder housing to said mixer and;

automatic control means for controlling said means for moving said piston, said first and second automatically operated valve means for injecting a predetermined amount of ozone gas into said mixer.

2. Apparatus as recited in claim 1 wherein said piston has a first face and a second face opposite the first face, and a piston rod extending generally perpendicular to said piston second face, exteriorly of said housing; and further comprising a transducer connected to said piston rod for determining the position of said piston rod with respect to the interior of said cylinder housing.

3. Apparatus as recited in claim 2 further comprising a first port disposed in said cylinder housing on a portion thereof adjacent said first piston face and when said piston is disposed at a first end of said housing, and second and third ports disposed in said cylinder housing at a second end of said housing opposite said first end and adjacent said second face of said piston.

4. Apparatus as recited in claim 3 further comprising fourth and fifth conduits connected to said second and third ports respectively and automatically operated valves disposed in said fourth and fifth conduits.

5. Apparatus as recited in claim 2 wherein said piston is made of plastic and is elongated in the dimension of said piston rod, being releasably attached to said piston rod.

6. Apparatus as recited in claim 5 further comprising first and second spaced O-rings extending around the circumference of said piston between said first and second faces thereof and for sealing said piston in gas tight relationship with said cylinder housing.

7. Apparatus as recited in claim 1 wherein said means for moving said piston comprises a source of gas under pressure, a third conduit means connecting said source to said housing adjacent said second face of said piston, and third automatically operated valve means disposed in said third conduit means.

8. Apparatus as recited in claim 7 wherein said mixer comprises a fluidizing mixer.

9. Apparatus as recited in claim 8 further comprising an ozone destruction means operatively connected to said vent from said mixer and to said first conduit means, said first automatically operated valve means comprising a three way valve.

10. Apparatus as recited in claim 9 further comprising residual ozone analyzing means disposed between said mixer vent means and said ozone destruction means.

11. Apparatus as recited in claim 10 wherein said ozone analyzer comprises a pair of closed vessels each having a solution of potassium iodide or the like therein at a predetermined level, with an inlet conduit extending into each said vessel below the surface of said liquid/level, and an outlet conduit extending from each said vessel above the level of said liquid.

12. Apparatus as recited in claim 1 further comprising purge means for purging gas containing residual ozone from said mixer after utilization thereof in a laboratory test.

13. Apparatus as recited in claim 1 wherein the means for injecting a predetermined amount of ozone containing gas further comprises means for injecting at a desired time between just prior to mixer start up, and to about one second after mixer start up.

14. Apparatus as recited in claim 7 wherein said piston has a first face and a second face opposite said first face, and further comprising:

a piston rod extending generally perpendicularly to said second face, exteriorly of said cylinder housing; and a transducer exterior of said housing and operatively connected to said piston rod for determining the position of said piston rod with respect to the interior of said cylinder housing.

15. Apparatus as recited in claim 1 further comprising first and second spaced O-rings extending around the circumference of said piston between first and second faces thereof and for sealing said piston in gas tight relationship with said cylinder housing.

* * * * *

UNITED STATES PATENT AND TRADEMARK OFFICE

CERTIFICATE OF CORRECTION

PATENT NO. : 5,382,326

DATED : January 17, 1995

INVENTOR(S) : Szopinski, et al

It is certified that error appears in the above-indentified patent and that said Letters Patent is hereby corrected as shown below:

On the title page, item [75] --Andries R. Daamen of Martinez, Georgia-- should appear as one of the inventors.

Signed and Sealed this

Fourth Day of April, 1995

*Attest:*

Bruce Lehman

BRUCE LEHMAN

*Attesting Officer*

*Commissioner of Patents and Trademarks*